US007603795B2

(12) United States Patent
Pallatin

(10) Patent No.: US 7,603,795 B2
(45) Date of Patent: Oct. 20, 2009

(54) BUCKLE FOR A SPORTS BOOT AND A SPORTS BOOT HAVING SUCH BUCKLE

(75) Inventor: Pascal Pallatin, Gresy sur Aix (FR)

(73) Assignee: Salomon S.A.S., Metz-Tessy (FR)

( * ) Notice: Subject to any disclaimer, the term of this patent is extended or adjusted under 35 U.S.C. 154(b) by 477 days.

(21) Appl. No.: 11/374,059

(22) Filed: Mar. 14, 2006

(65) Prior Publication Data

US 2006/0207126 A1 Sep. 21, 2006

(30) Foreign Application Priority Data

Mar. 15, 2005 (FR) ..... 05 02562

(51) Int. Cl.
*A43B 5/04* (2006.01)

(52) U.S. Cl. ..... 36/50.5; 24/68 SK

(58) Field of Classification Search ..... 36/50.1, 36/50.5; 24/68 SK, 70 SK, 71 SK
See application file for complete search history.

(56) References Cited

U.S. PATENT DOCUMENTS 3,545,106 A * 12/1970 Hans ..... 36/117.1
3,818,547 A * 6/1974 Baso ..... 24/70 SK
4,051,611 A * 10/1977 Chalmers ..... 36/50.5
4,186,501 A 2/1980 Salomon
4,372,061 A * 2/1983 Pozzobon ..... 36/119.1
4,575,956 A 3/1986 Paris
4,593,483 A 6/1986 Paris
5,251,388 A * 10/1993 Pozzobon et al. ..... 36/50.5
5,345,698 A 9/1994 Billet et al.
5,383,258 A * 1/1995 Nicoletti ..... 24/68 SK
5,425,187 A * 6/1995 Artusi et al. ..... 36/117.1
5,509,180 A 4/1996 Benetti et al.
5,519,951 A 5/1996 Paris
5,553,400 A * 9/1996 Wittmann et al. ..... 36/50.5
5,586,367 A 12/1996 Benoit
5,694,707 A * 12/1997 Conte ..... 36/115
5,787,611 A * 8/1998 Bonaventure ..... 36/117.1
5,983,531 A 11/1999 Chaigne et al.
6,145,168 A 11/2000 Baggio et al.

(Continued)

FOREIGN PATENT DOCUMENTS

DE 78 21 138 U1 10/1978

(Continued)

*Primary Examiner*—Ted Kavanaugh
(74) *Attorney, Agent, or Firm*—Greenblum & Bernstein P.L.C.

(57) ABSTRACT

A buckle for a sports boot, such as an alpine ski boot, as well as a sports boot equipped with such buckle. The buckle is adapted to move two parts of the boot upper relative to each other for tightening the boot on the foot and/or lower leg of the wearer, the buckle including a base fixed on the first of the boot parts, a lever articulated on the base, and a hooking element connected to the lever by means of a rod. The lever contour demarcates a surface, the area of which is greater than 27 $cm^2$ and the width thereof being greater than 53 mm. The buckle also includes a rack fixed to the second of the parts of the boot, the width of which is greater than 25 mm. With a buckle having such dimensions, a ski boot according to the invention can be equipped with only two such buckles, one on the lower base and one on the cuff.

25 Claims, 3 Drawing Sheets

U.S. PATENT DOCUMENTS

| | | | |
|---|---|---|---|
| D452,368 | S | 12/2001 | Chaigne |
| 2005/0081408 | A1 | 4/2005 | Chaigne et al. |

FOREIGN PATENT DOCUMENTS

| | | | |
|---|---|---|---|
| DE | 201 00 054 | U1 | 8/2001 |
| EP | 0 945 080 | A1 | 9/1999 |
| EP | 1 142 497 | A1 | 10/2001 |
| EP | 1 493 347 | A1 | 1/2005 |
| WO | WO-84/02063 | A1 | 6/1984 |

* cited by examiner

Prior Art

BUCKLE FOR A SPORTS BOOT AND A SPORTS BOOT HAVING SUCH BUCKLE

CROSS-REFERENCE TO RELATED APPLICATION

This application claims priority under 35 U.S.C. §119 of French Patent Application No. 05.02562, filed on Mar. 15, 2005, the disclosure of which is hereby incorporated by reference thereto in its entirety.

BACKGROUND OF THE INVENTION

1. Field of the Invention

The invention relates to a buckle closure, or tightening device, for sports footwear, such as for a ski boot. The buckle includes a base fixed on the boot, or other article of footwear, a lever articulated on the base, and a hooking element connected to the lever by means of a tie rod.

2. Description of Background and Relevant Information

The document EP 1 142 497 describes a ski boot equipped with four buckles. Two of the buckles are positioned for tightening the lower leg and the other two for tightening the shell base. Fastening such a boot can be relatively time-consuming and can be difficult for people lacking sufficient muscular strength in the hand, the wrist, or the arm. Indeed, the manipulation of the levers of the buckles can necessitate substantial strength.

SUMMARY OF THE INVENTION

An object of the invention is to provide for a buckle closure, or tightening device, hereinafter "buckle," that enables the limitations of the devices known in the prior art to be overcome. In particular, an object of the invention is a tightening device that improves the manipulation ergonomics.

An additional object of the invention is to provide for an article of footwear, hereinafter referred to sometimes simply as a boot, which includes such tightening device.

The aforementioned objects of the invention are achieved by a buckle adapted to bring two parts of the boot upper closer together or, if such two parts are overlapping panels or flaps, to move the two parts relative to each other for tightening the boot upon the foot and/or lower leg of the wearer. Such buckle includes a base fixed on the first of the two parts of the boot, a lever articulated on the base, a hooking element connected to the lever by means of a rod, with the contour of the lever demarcating a surface, the area of which is greater than 27 $cm^2$.

The buckle according to the invention includes a rack fixed to the second of the two parts of the boot, the rack having a width greater than 25 mm.

Increasing the contour area notably translates into a wider lever, the maximum width of which is greater than 53 mm, which all the more ameliorates the ergonomics for handling the lever.

In a particular embodiment of the invention, a ski boot is provided with only two buckles, one for tightening the foot within the lower shell, or shell base, the other one for tightening the lower leg within the cuff, or collar, of the boot.

BRIEF DESCRIPTION OF DRAWINGS

The invention will be better understood upon reading the description that follows, to which are annexed drawings, and in which.

DETAILED DESCRIPTION OF THE INVENTION

Figure 1:
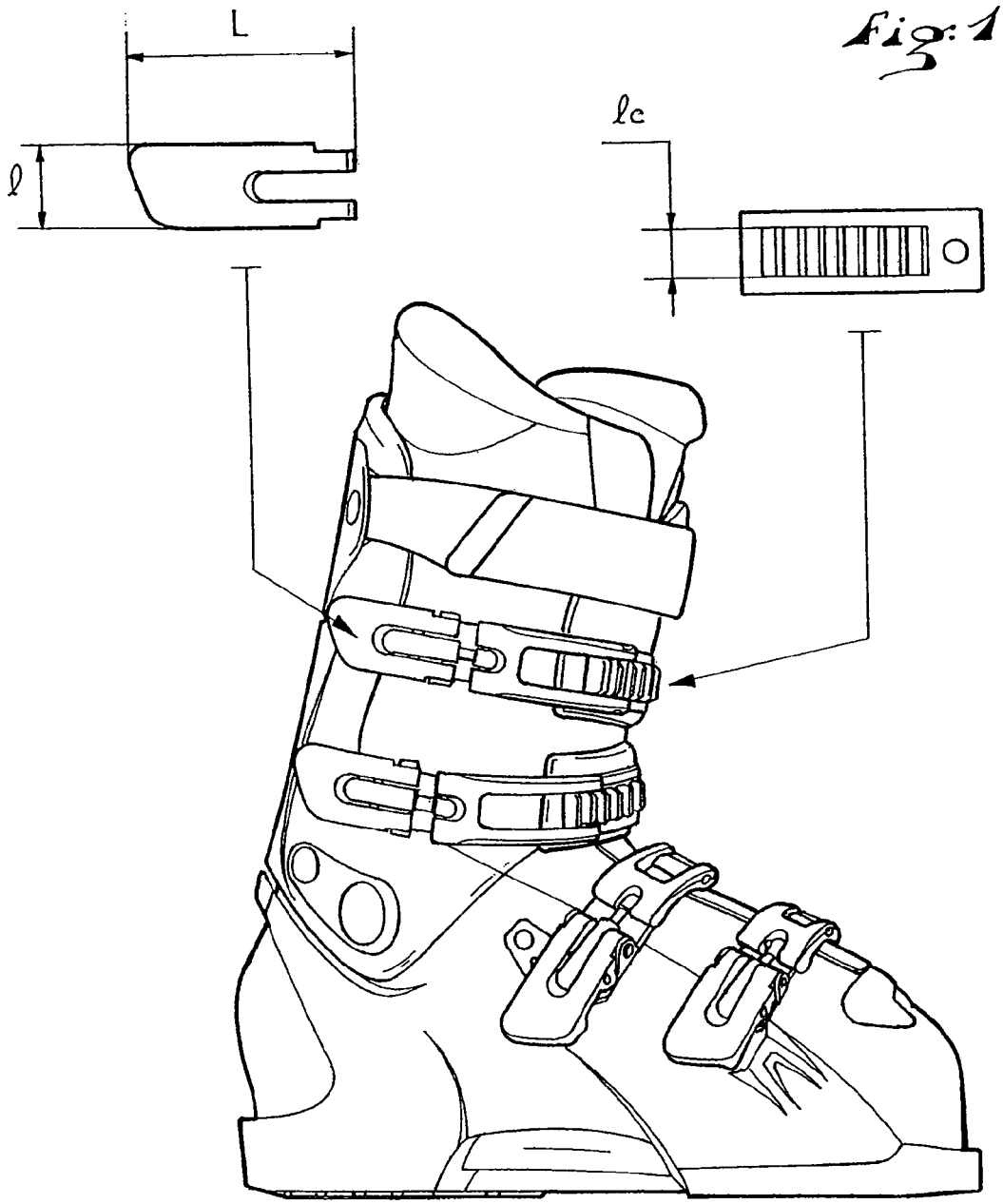
FIG. 1 is a view of a ski boot equipped with a buckle according to the prior art.

FIG. 1 is a side view of a ski boot equipped with fastening buckles according to the prior art. These are common, traditional buckles. The levers of such buckles have a contour, the area of which is between 10 and 13 $cm^2$. Reference is made here to the area within the contour of the lever and not to the area of the lever itself. Indeed, it is the lever contour, i.e., the periphery, that is taken into account to assess the manipulation ergonomics of the buckle, and notably, the handling of the lever. The lever may or may not be perforated, but its outer edges define its contour that control the handling thereof by the user.

The lever has a substantially rectangular shape. The maximal length "L" is typically equal to 5 centimeters (cm), or approximately 5 cm, whereas the width "l" is equal to 2.5 cm. The area of within the contour of the lever reaches about 12.5 $cm^2$. The rack is provided with a plurality of teeth having a width "lc" equal to 1 cm.

Levers having such dimensions are not always easy to manipulate, especially when the user wears ski gloves, which can be particularly thick to ensure an efficient protection against the cold.

Figure 2:
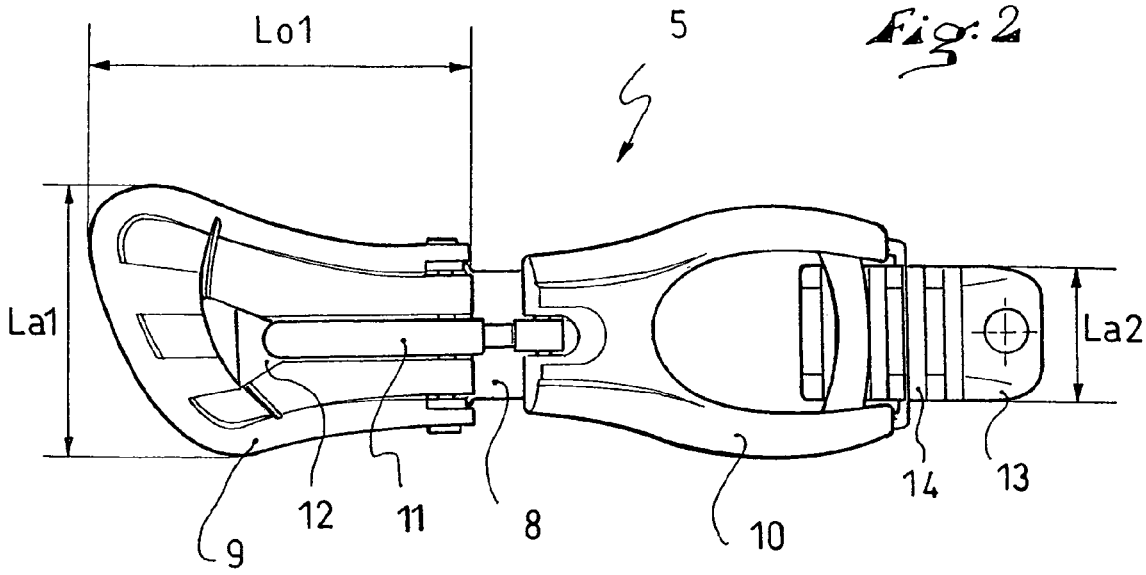
FIG. 2 is a top view of a buckle according to the invention.
Figure 3:
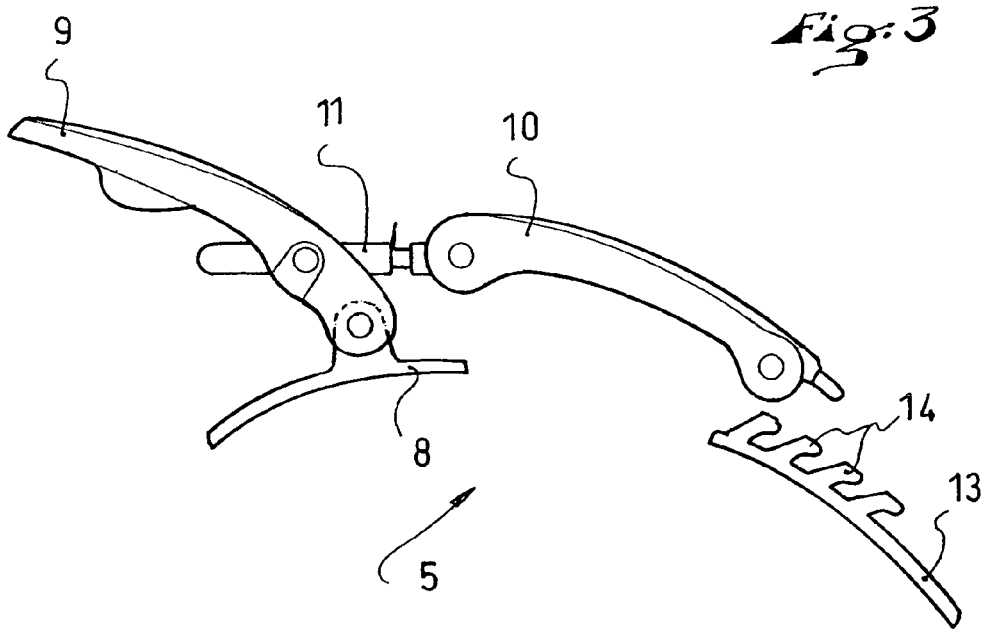
FIG. 3 is a side view of a buckle according to FIG. 2.

FIGS. 2 and 3 show the buckle 5 according to the invention. The buckle 5 includes a base 8 adapted to fix the buckle on one of the parts of the boot, a lever 9 articulated on the base 8, and a hooking element 10, or loop, connected to the lever 9 by means of a rod 11, such as a threaded rod for adjustment. As can be seen in the drawings of the exemplary embodiment of the invention, the lever 9 is articulated to the base about an axis that extends in a direction different, such as transverse of the boot, from the direction in which the lever is elongated. The linkage of the rod 11 with the lever 9, as well as that of the rod with the hooking element 10, are pivotable linkages. The lever 9 can be made of a plastic material and includes a central opening 12 in which the rod 11 is housed. The maximum width "La1" of the lever 9 is greater than 5.3 cm, whereas its maximum length "Lo1" is greater than 6 cm.

Because of its increased dimensions with respect to buckles of the prior art, the lever contour demarcates a surface, the area "S" of which is greater than 27 $cm^2$.

The hooking element 10 includes a main portion that can be made of a plastic material, as well as a portion that can be made in the form of a metal pin adapted to engage with the teeth 14 of the rack 13. As can be seen in FIG. 2, the hooking element 10 has a width that enables it to become engaged with only a single rack, i.e., the metal pin is shown to have a width slightly greater than the length of the teeth 14.

The rack 13 also has increased dimensions. The width "La2" of the rack is greater than 2.5 cm and can be as great as 2.8 cm in the particular embodiment illustrated. The rack can be made of a plastic material.

The choices of materials for the manufacture of the buckle's various elements are not limiting, and any material can be used to make them without leaving the scope of the invention. For example, the lever or the rack can be manufactured by molding an aluminum-based metallic alloy.

Figure 4:
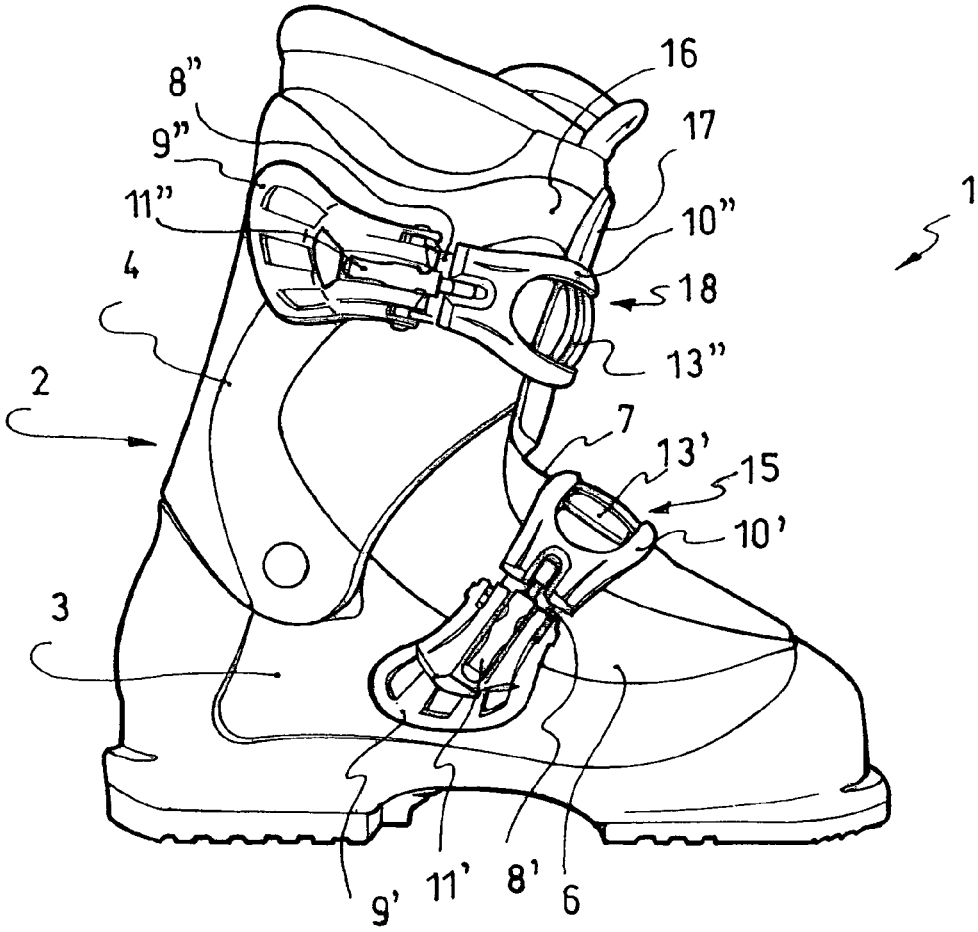
FIG. 4 is a view of a ski boot equipped with buckles according to the invention.

FIG. 4 is a side view of a ski boot equipped with a pair of buckles according to the invention. The boot 1 includes a rigid outer upper 2 that includes of a lower shell 3, or shell base, on which a cuff 4, or collar, is mounted. The lower shell 3, in the illustrated embodiment, is a one-piece element made by injection of a plastic material. It includes a wide upper opening allowing the passage of the foot. This wide opening extends forward on the boot by means of a longitudinal slit, which is covered by a pair of overlapping panels, or flaps, that can move one with respect to the other in order to adjust the enclosing and tightening of the shell against the user's foot enclosed therein. A single shell buckle 15 ensures the tightening of the shell 3. The buckle includes a base 8' fixed to the lateral panel/flap 6, a lever 9', articulated on the base 8', and a hooking element 10' connected to the lever 9' by means of a rod 11'. The linkage of the rod 11' with the lever 9' is a pivotable linkage. The lever 9' has a contour, the area of which is substantially equal to 27 $cm^2$ or greater.

The shell buckle also includes a rack 13' that is fixed to the medial panel/flap 7 of the shell 3.

The cuff 4 is fixed to the lower shell 3. It includes a medial panel/flap 16 and a lateral panel/flap 17 that overlap to enclose the user's lower leg. A single lower-leg buckle 18 carries out the tightening of the cuff. Similar to the shell buckle 15, the lower-leg buckle 18 includes a base 8" fixed to the lateral panel/flap 16, a lever 9", a rod 11", a hooking element 10", and a rack 13" fixed to the medial panel 17.

The use of the boot equipped with tightening buckles according to the invention is simplified in that only two tightening buckles need to be fastened. Furthermore, their manipulation is made easier due to the large size of the levers 9' and 9".

The invention, including the embodiment illustrated in FIG. 4, improves upon prior art boots such as is shown in FIG. 1, whereby the exterior buckles 15 and 18 of the FIG. 4 embodiment are the only adjustable tightening mechanisms for the boot. No internal adjustable tightening mechanisms are part of the illustrated embodiment, such as adjustable cables, etc., which are used in so-called rear-entry ski boots. Further, the type of ski boot shown in FIG. 4 can be regarded as a two-part ski boot, which does not include front and/or rear spoilers, which pivot to open positions to facilitate entry and exit of the foot, which spoilers characterize certain rear and mid-entry boots.

Although the respective positions of the buckles 15 and 18 are shown to be somewhat centered along the lengths of the lower shell 3 and the cuff 4, respectively, the positions of the buckles can be otherwise positioned on their respective parts of the boot. For example, the buckle 15 of FIG. 4 is positioned at the instep, or approximately thereat, although it could be positioned on the shell otherwise, such as between the metatarsophalangeal area and the instep area of the shell.

The invention is not limited to the particular embodiment described above, which has been presented as an example of the invention, but also includes any equivalent embodiment.

LIST OF ELEMENTS

The following is a listing of the elements referenced in the detailed description of the invention:

1 boot
2 upper
3 lower shell
4 cuff
5 buckle
6 lateral part
7 medial part
8, 8', 8" base
9, 9', 9" lever
10, 10', 10" hooking element
11', 11" rod
12 central opening
13, 13', 13" rack
14 metal pin
15 shell buckle
16 lateral panel or flap
17 medial panel or flap
18 lower-leg buckle

The invention claimed is:

1. A buckle adapted to move two parts of an article of footwear relative to each other for tightening the boot upon the foot and/or lower leg of a wearer, said buckle comprising:
a base adapted to be fixed on a first of the two parts of the article of footwear;
a lever having a lengthwise dimension greater than a widthwise dimension, said lever being articulated on said base about an axis, said lengthwise dimension extending in a direction different from a direction said axis extends;
a hooking element adapted to engage an element mounted on the second of the two parts of the article of footwear;
a rod connecting said hooking element to said lever;
said lever having a contour demarcating a surface, said surface having an area greater than 27 $cm^2$.

2. A buckle according to claim 1, further comprising:
a rack fixed to the second of the two parts of the article of footwear, the rack having a width greater than 25 mm.

3. A buckle according to claim 1, wherein:
the lever has a maximum width greater than 53 mm.

4. A buckle according to claim 1, wherein:
said lever is made of a metallic material.

5. A buckle according to claim 4, wherein:
said metallic material is an aluminum-based alloy.

6. A buckle according to claim 1, further comprising:
said element adapted to be mounted on the second of the two parts of the article of footwear;
said hooking element having a width to be adaptable to engage no more than one said element.

7. A buckle according to claim 1, further comprising:
said element adapted to be mounted on the second of the two parts of the article of footwear;
said element comprising a rack having a plurality of teeth;
said hooking element having a pin for engaging with said teeth;
said buckle having no more than one lever, no more than one hooking element, and no more than one pin.

8. A ski boot comprising:
a first part and a second part, both of said parts adapted to extend along a wearer's foot and/or lower leg;
at least one buckle adapted to move said first part relative to said second part for tightening the boot on the wearer's foot and/or lower leg, said buckle comprising:
a base fixed on said first part;
a lever having a lengthwise dimension greater than a widthwise dimension, said lever being articulated on said base about an axis, said lengthwise dimension extending in a direction different from a direction said axis extends;
a hooking element;
a rod connecting said hooking element to said lever;
said lever having a contour comprising a surface, said surface having an area greater than 27 $cm^2$.

9. A ski boot according to claim 8, wherein:
the ski boot comprises a lower shell adapted to extend over a wearer's foot;
said first and second parts are part of said lower shell of the ski boot, said buckle being adapted to tighten the ski boot on the wearer's foot;

said buckle is the only buckle of the ski boot mounted on said lower shell for tightening the ski boot on the wearer's foot.

10. A ski boot according to claim 8, wherein:

the ski boot comprises a cuff adapted to extend over a wearer's lower leg;

said first and second parts are part of said cuff of the ski boot, said buckle being adapted to tighten the ski boot on the wearer's lower leg;

said buckle is the only buckle of the ski boot mounted on said cuff for tightening the boot to the wearer's lower leg.

11. A ski boot according to claim 8, wherein:

said lever is made of a metallic material.

12. A ski boot according to claim 11, wherein:

said metallic material is an aluminum-based alloy.

13. A ski boot according to claim 8, further comprising:

an element adapted to be mounted on the second part;

said hooking element having a width to be adaptable to engage no more than one said element.

14. A ski boot according to claim 8, further comprising:

an element adapted to be mounted on the second part;

said element comprising a rack having a plurality of teeth;

said hooking element having a pin for engaging with said teeth;

said buckle having no more than one lever, no more than one hooking element, and no more than one pin.

15. A ski boot comprising:

two and only two buckles mounted on the ski boot for tightening a wearer's foot and lower leg within the ski boot;

a first part and a second part adapted to extend along the wearer's foot;

at least one of said two buckles being adapted to move said first part relative to said second part for tightening the boot on the wearer's foot and/or lower leg, said buckle comprising:

a base fixed on said first panel;

a lever having a lengthwise dimension greater than a widthwise dimension, said lever being articulated on said base about an axis, said lengthwise dimension extending in a direction different from a direction said axis extends;

a hooking element;

a rod connecting said hooking element to said lever;

said lever having a contour comprising a surface, said surface having an area greater than 27 $cm^2$.

16. A ski boot according to claim 15, wherein:

said lever is made of a metallic material.

17. A ski boot according to claim 16, wherein:

said metallic material is an aluminum-based alloy.

18. A ski boot according to claim 15, further comprising:

an element adapted to be mounted on the second part;

said hooking element having a width to be adaptable to engage no more than one said element.

19. A ski boot according to claim 15, further comprising:

an element adapted to be mounted on the second part;

said element comprising a rack having a plurality of teeth;

said hooking element having a pin for engaging with said teeth;

said buckle having no more than one lever, no more than one hooking element, and no more than one pin.

20. A ski boot comprising:

a lower shell adapted to extend over a wearer's foot, said lower shell comprising first and second parts;

a lower leg portion connected to said lower shell, said lower leg portion of the ski boot adapted to extend along a user's lower leg, said lower leg portion comprising first and second parts;

one and only one buckle mounted on said lower shell to tighten the wearer's foot within said lower shell;

one and only one buckle mounted on said lower leg portion to tighten the wearer's lower leg within said lower leg portion;

each of said buckles comprising:

a base fixed on said first part of said lower shell or on said first part of said lower leg portion;

a lever having a lengthwise dimension greater than a widthwise dimension, said lever being articulated on said base about an axis, said lengthwise dimension extending in a direction different from a direction said axis extends;

a hooking element;

a rod connecting said hooking element to said lever;

said lever having a contour comprising a surface, said surface having an area greater than 27 $cm^2$.

21. A ski boot according to claim 20, wherein:

said lever of each of said buckles is made of a metallic material.

22. A ski boot according to claim 21, wherein:

said metallic material is an aluminum-based alloy.

23. A ski boot according to claim 20, further comprising:

an element adapted to be mounted on the second part;

said hooking element having a width to be adaptable to engage no more than one said element.

24. A ski boot according to claim 20, further comprising:

an element adapted to be mounted on the second part;

said element comprising a rack having a plurality of teeth;

said hooking element having a pin for engaging with said teeth;

said buckle having no more than one lever, no more than one hooking element, and no more than one pin.

25. A buckle adapted to move two parts of an article of footwear relative to each other for tightening the boot upon the foot and/or lower leg of a wearer, said buckle comprising:

a base adapted to be fixed on a first of the two parts of the article of footwear;

a lever articulated on said base said lever having a contour demarcating a surface, said surface having an area greater than 27 $cm^2$;

a hooking element adapted to engage an element mounted on the second of the two parts of the article of footwear;

a rod connecting said hooking element to said lever; and a rack fixed to the second of the two parts of the article of footwear, the rack having a plurality of teeth, each of said teeth extending along a width of the rack, the width of the rack having a width greater than 25 mm.

* * * * *